US007991304B2

(12) United States Patent
Pozniakas et al.

(10) Patent No.: US 7,991,304 B2
(45) Date of Patent: Aug. 2, 2011

(54) DIAGNOSTIC SYSTEMS AND METHODS FOR PROVIDING DIAGNOSTIC INFORMATION DURING SERVICING OF AN IMAGE PROCESSING APPARATUS

(75) Inventors: Robert Steven Pozniakas, Rochester, NY (US); Michael Nicholas Soures, Webster, NY (US); Robert A. Gross, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 514 days.

(21) Appl. No.: 12/186,282

(22) Filed: Aug. 5, 2008

(65) Prior Publication Data

US 2010/0034543 A1 Feb. 11, 2010

(51) Int. Cl.
*G03G 15/00* (2006.01)
*G03G 21/00* (2006.01)
*G03G 21/20* (2006.01)

(52) U.S. Cl. ..... 399/11; 399/93; 399/98; 399/99; 399/358; 399/359

(58) Field of Classification Search ..... 399/11, 399/93, 98, 99, 353, 354, 355, 358, 359, 399/360

See application file for complete search history.

(56) References Cited

U.S. PATENT DOCUMENTS

| | | | | |
|---|---|---|---|---|
| 5,391,218 | A * | 2/1995 | Jorgenson et al. | 95/20 |
| 5,427,596 | A * | 6/1995 | Jorgenson et al. | 96/399 |
| 5,918,085 | A * | 6/1999 | Rollins et al. | 399/27 |
| 5,923,922 | A * | 7/1999 | Ishida et al. | 399/98 |
| 6,453,148 | B1 * | 9/2002 | Friedrich et al. | 399/358 |
| 7,555,246 | B2 * | 6/2009 | Zirilli | 399/253 |
| 2005/0240312 | A1 * | 10/2005 | Terry et al. | 700/276 |
| 2006/0125623 | A1 * | 6/2006 | Appelt et al. | 340/521 |
| 2008/0066479 | A1 * | 3/2008 | Butler et al. | 62/183 |
| 2008/0073440 | A1 * | 3/2008 | Butler et al. | 236/91 R |
| 2008/0223111 | A1 * | 9/2008 | McDonald et al. | 73/37 |
| 2008/0315000 | A1 * | 12/2008 | Gorthala et al. | 236/46 C |

* cited by examiner

*Primary Examiner* — David M Gray
*Assistant Examiner* — Francis Gray
(74) *Attorney, Agent, or Firm* — Oliff & Berridge, PLC

(57) ABSTRACT

A diagnostic system that provides a service technician with service information during servicing of an image processing apparatus includes at least one counter that is incremented during operation of the image processing apparatus, a pressure detecting unit that detects a pressure at a point in an air flow path on the condition that the at least one counter is reset to zero after initial servicing of the image processing apparatus, a determining unit that determines whether a difference between the detected pressure and a fault threshold pressure is less than a predetermined margin, and a display unit that displays a fault code indicating additional servicing of the image processing apparatus is recommended on the condition that the determining unit determines that the difference between the detected pressure and the predetermined threshold pressure is less than the predetermined margin.

15 Claims, 5 Drawing Sheets

DIAGNOSTIC SYSTEMS AND METHODS FOR PROVIDING DIAGNOSTIC INFORMATION DURING SERVICING OF AN IMAGE PROCESSING APPARATUS

BACKGROUND

The present disclosure relates to diagnostic systems and methods for providing diagnostic information during servicing of an image processing apparatus.

An image processing apparatus can include a photosensitive drum, on which an electrostatic latent image is formed. Toner can be applied to the photosensitive drum by a developing roller. A printing medium can then be supplied across the photosensitive drum to transfer the toner onto the printing medium and thereby form an image.

After a printing job is completed, residual toner and paper dust often remain on the photosensitive drum. A cleaning brush can be provided to clean the photosensitive drum and remove the residual toner and paper dust. However, toner may accumulate on the cleaning brush, and thereby reduce the effectiveness of the cleaning brush in removing residual toner from the photosensitive drum.

SUMMARY

Nuvera™ is an image processing apparatus produced by Xerox® that is generally used for high-volume printing jobs. Nuvera™ may include a single 120 or 144 print per minute print engine, or alternatively two 144 print per minute print engines coupled together.

Nuvera™ includes a cleaner air system for vacuuming toner out of the cleaning brush in order to prevent accumulation of toner deposits on the cleaning brush and maintain its effectiveness in removing residual toner from the photosensitive drum. The cleaner air system includes a first manifold, a second manifold, and a final filter that together form an air flow path for removal of toner.

During the vacuuming process, toner deposits tend to fall out of, or otherwise be removed from, the air stream and accumulate in various portions of the cleaner air system. The first manifold is particularly vulnerable to toner accumulation due to its shape and narrow cross-section. Toner also accumulates in the final filter, thereby reducing airflow and increasing the vacuum. Thus, the final filter needs to be periodically replaced. As toner falls out of the air flow path and accumulates in various portions of the cleaner air system, the pressure in the cleaner air system decreases and the effectiveness of the cleaner air system in removing toner deposits from the cleaning brush is reduced.

The present disclosure provides diagnostic systems and methods for determining when a pressure level in the cleaner air system is within a predetermined margin from a fault threshold value (determined in advance to be a level at which toner removal from the cleaning brush is ineffectual). The disclosed systems and methods may otherwise provide a service technician with recommendations for taking further action to alter the pressure level to regain the effectiveness of the vacuuming process.

An exemplary diagnostic system is disclosed that provides service information during servicing of an image processing apparatus, which includes an air flow path for removal of toner particulate deposits. The exemplary system includes at least one counter that is incremented during operation of the image processing apparatus based on predetermined criteria, wherein after servicing of the image processing apparatus, the at least one counter is reset to zero. A pressure detecting unit detects a pressure at a point in the air flow path. A determining unit determines a difference between a pressure detected by the pressure detecting unit and a fault threshold pressure. A failure detecting unit displays at least one fault code indicating additional servicing of the image processing apparatus is recommended on the condition that the determining unit determines that the difference is less than a predetermined margin.

An exemplary diagnostic method is disclosed that provides service information during servicing of an image processing apparatus, which includes an air flow path for removal of toner particulate deposits. The exemplary method includes detecting a pressure at a point in the air flow path on the condition that at least one counter is reset to zero after initial servicing of the image processing device. The at least one counter is incremented during operation of the image processing device based on predetermined criteria. The exemplary method also includes determining whether a difference between the detected pressure and a fault threshold pressure is less than a predetermined margin, and displaying a fault code indicating additional servicing of the image processing apparatus is recommended on the condition that it is determined that the difference between the detected pressure and the fault threshold pressure is less than the predetermined margin.

EMBODIMENTS

Figure 1:
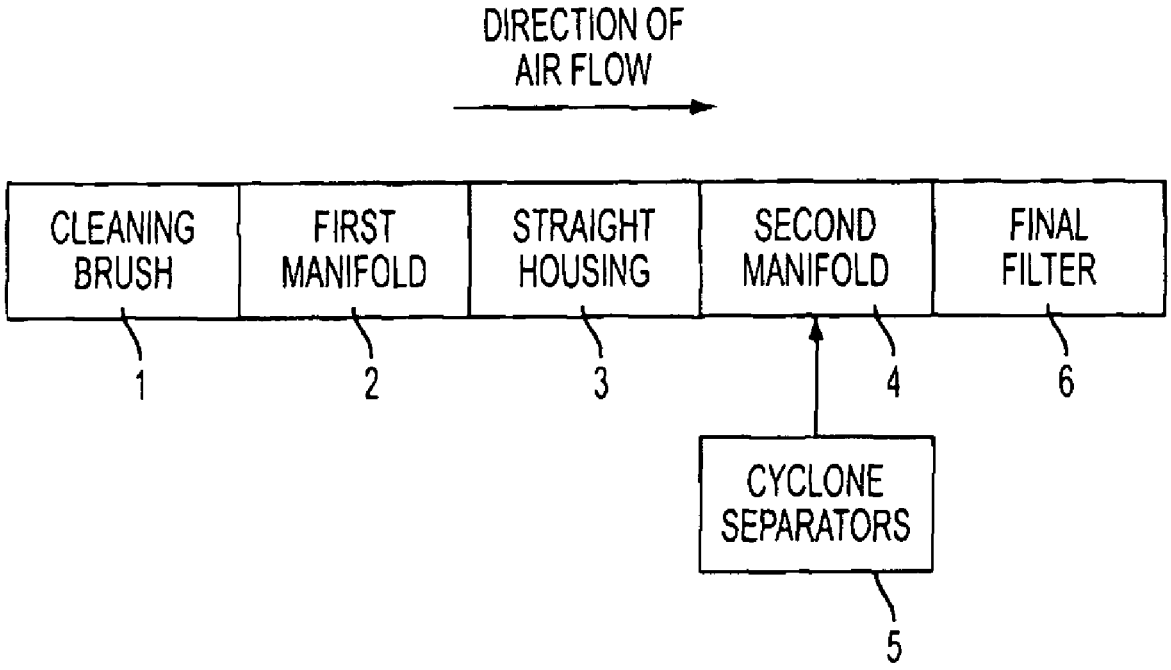
FIG. 1 is schematic diagram of the cleaner air system.

FIG. 1 schematically depicts the cleaner air system according to the present disclosure. The cleaner air system vacuums toner out of a cleaning brush 1 in order to prevent accumulation of toner deposits on the cleaning brush 1 and maintain its effectiveness in removing residual toner from the photosensitive drum. The cleaner air system includes a first manifold 2 that is disposed adjacent to the cleaning brush 1. The first manifold is the first component of the cleaner air system in the direction of airflow.

The first manifold has a curved shape and a narrow cross section that is dictated by space considerations. Due to the shape and configuration of the first manifold, toner particles are prone to falling out of the air stream as they pass through the first manifold. These toner particles accumulate inside the first manifold and a restriction to the flow of air develops. Toner accumulation inside the first manifold reduces the pressure of the air stream.

After passing through the first manifold, air flows through a straight housing 3. The straight housing 3 is substantially cylindrical and presents a favorable cross section and shape. Thus, toner particles tend not to fall out of the air stream as it passes through the straight housing 3.

After passing through the straight housing 3, the air stream enters a second manifold 4 that includes cyclone separators 5. The second manifold 4 may also be referred to as a cyclone inlet duct. The second manifold 4 also has a curved shape such that the air stream undergoes a sharp bend as it passes through the second manifold. Toner particles tend to fall out of the air stream at this sharp bend and accumulate on an inside surface of the second manifold. This, in turn, creates an airflow restriction that reduces the pressure of the air stream.

After the air stream undergoes the sharp turn as a result of the shape of the second manifold 4, the air stream passes through the cyclones 5. Toner tends not to accumulate on surfaces of the cyclones 5. Further, the cyclones 5 are highly efficient in removing toner particles from the air stream.

After passing through the cyclones 5, the air stream passes through a final filter 6. The purpose of the final filter 6 is to remove any remaining toner particles form the air stream that have not been removed by the cyclones 5. Over time, toner particles tend to accumulate on the final filter 6, thereby reducing airflow and increasing the vacuum. That is, toner accumulation on the final filter 6 leads to an increase in the pressure drop across the final filter over time.

Nuvera™ is a high-frequency service item (HFSI) that requires periodic maintenance. As part of this periodic maintenance, the cleaner air system is serviced in order to ensure that toner particles and other additives have not accumulated inside the system to such an extent that the cleaner air system is no longer effective in removing toner particles from the cleaning brush. As described earlier, the first manifold is particular vulnerable to toner accumulation due to its curved shaped and narrow cross section. Further, toner also tends to accumulate at the sharp bend in the second manifold as well as on the final filter.

During initial servicing, the service technician may attempt to clean the inside surface of the first manifold in order to remove toner deposits. However, due to its narrow cross section and curved shape, cleaning the first manifold is difficult. It is instead recommended that the service technician replace the first manifold. Replacing the first manifold is less time-intensive and more cost-effective.

Also as part of the initial servicing, the service technician will clean the second manifold to remove toner deposits on inner surfaces of the second manifold. The second manifold is significantly easier to clean than the first manifold due to its wider cross section. The service technician uses a cleaning tool designed to fit the contour of the second manifold. The second manifold is generally not replaced during initial servicing because the second manifold can be adequately cleaned and replacing the second manifold can be costly. Further, the second manifold includes an adhesive that is applied as a weak sealant and it cannot be ensured that the service technician will adequately seal the second manifold after replacement.

In addition to servicing the first and second manifolds, the service technician may replace the final filter. The final filter is generally not cleaned because toner particles become embedded in the internal pleats of the filter and are difficult to remove.

Counters are associated with various components of the cleaner air system. Specifically, a counter may be associated with the first manifold and the second manifold together and a counter may be associated with the final filter. The counters are incremented based on predetermined criteria that may include, for example, a number of charged panels or a number of prints.

A charged panel occurs when the photosensitive drum is charged so that an electrostatic image can be developed on it. The number of charged panels exceeds the number of prints because a charged panel is produced on cycling up and cycling down of the image processing apparatus. The charged panels not used to produce prints may be used to form test images. An example of a test image is a process control patch that is formed on the photosensitive drum and analyzed by a sensor to determine if the brightness levels are adequate before printing begins. For high-volume printing jobs performed using an image processing apparatus such as Nuvera™, the number of charged panels does not significantly deviate from the number of prints. However, if a large number of small-volume printing jobs are completed, the number of charged panels may significantly exceed the number of prints produced.

The counter associated with the first and second manifolds is incremented based on the number of charged panels. The counter associated with the final filter is incremented based on the number of prints. However, the present disclosure is not limited to this, and the counter for the first and second manifolds and the counter for the final filter may both be incremented based on the number of charged panels or the number of prints.

The service technician generally performs initial servicing of the image processing apparatus at periodic intervals based on the counter readings. For example, initial servicing may be performed when one of the counters reaches 3,000,000. The length of the interval between servicing may be a function of airflow and toner type.

After a service technician performs initial servicing of the cleaner air system, the service technician resets the counter depending on the type of initial servicing that was performed. If servicing is performed on at least one of the first manifold and the second manifold, the counter associated with the manifolds is reset. If the final filter is replaced during initial servicing, then the counter associated with the filter is reset.

If initial servicing is properly performed and the vacuum in the cleaner air system is restored to a near new level, the cleaner air system can efficiently operate in the interval between the next servicing. However, initial servicing of the cleaner air system is not always effective in removal of toner and other particulate deposits. Thus, as toner deposits continue to accumulate in the cleaner air system during operation of the image processing apparatus, the pressure level within the system will continue to decrease (i.e. a level of vacuum will increase with print volume). A fault threshold pressure $P_{T1}$ is determined to be a point at which air flow within the cleaner air system is no longer enough, given the toner deposit accumulation, to maintain effective cleaning and low toner emissions.

The cleaner air system may also function improperly as a result of an air leak within the system. Damaged or broken seals are typically the cause of air leaks. Inadequate sealing results in a low vacuum and increased pressure inside the cleaner air system. This low vacuum renders the cleaner air system ineffective in vacuuming toner off of the cleaning brush. A second fault threshold pressure $P_{T2}$ is a pressure level within the cleaner air system that is determined to be too high for the system to operate properly.

An exemplary diagnostic system and method according to the present disclosure determines whether a pressure level in the cleaner air system is within a predetermined margin from the fault threshold pressure $P_{T1}$ such that the pressure in the system may reach the fault threshold pressure $P_{T1}$ prior to the next periodic servicing.

Figure 2:
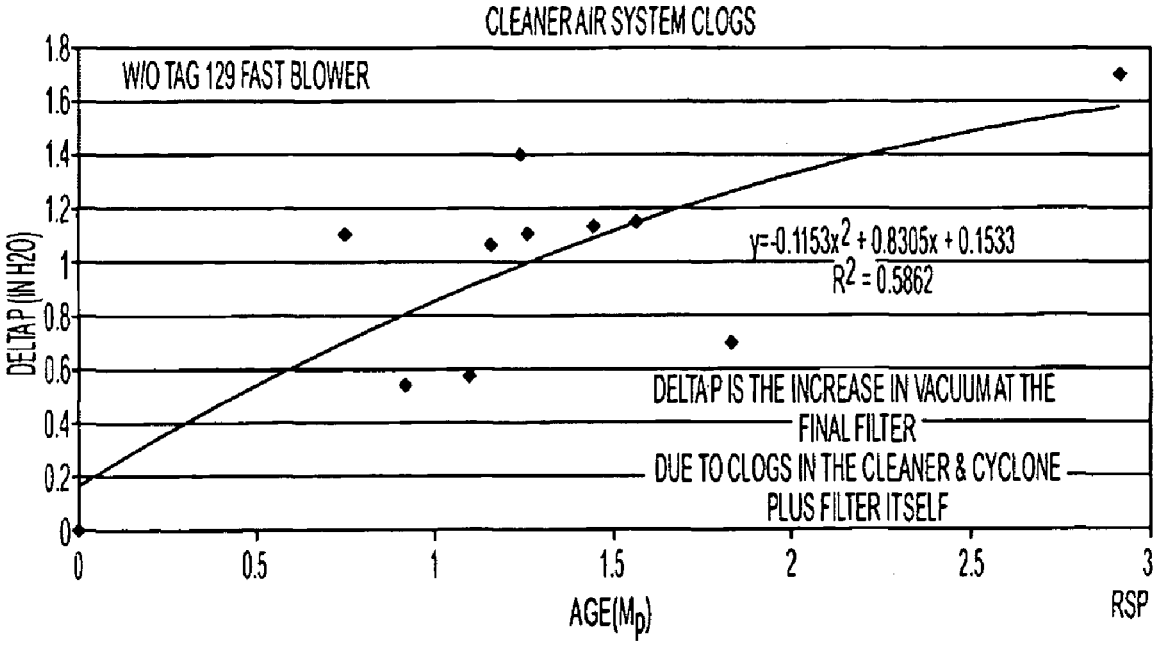
FIG. 2 is a plot of the change in pressure in the cleaner air system against operating time of an image processing apparatus.

FIG. 2 shows a least-squares regression of data points representing the decrease in pressure (i.e. increase in vacuum) in the cleaner air system as a function of an operation time (i.e. age) of a Nuvera™ device. The age may be measured in terms of number of prints or number of charged panels, as described earlier. Specifically, delta P represents the increase in vacuum at the final filter due to toner deposit accumulation in the first manifold, the second manifold, or the filter itself.

FIG. 2 shows that as the number of prints (or charged panels) increases, the pressure drop at the final filter increases as well.

Figure 3:
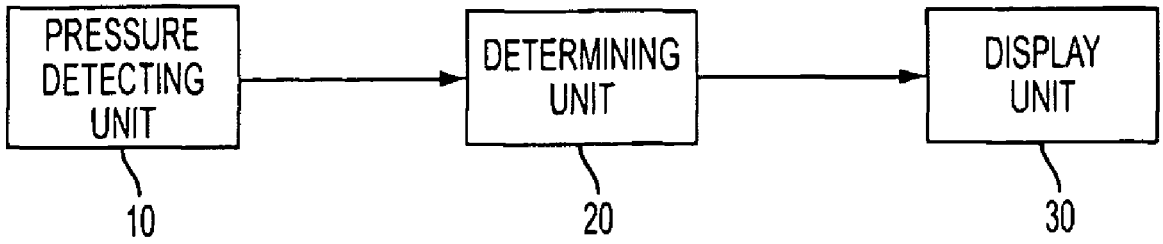
FIG. 3 is a block diagram of a diagnostic system according to an embodiment of the present disclosure.

FIG. 3 shows a block diagram of a diagnostic system according to the present disclosure. The diagnostic system includes a pressure detecting unit 10, a determining unit 20, and a display unit 30. The pressure detecting unit 10 may be disposed at any point along the first or second manifolds and detects a pressure of the air stream at that point.

In one exemplary embodiment of the present disclosure, the diagnostic system runs a diagnostic routine after the service technician has completed initial servicing of the cleaner air system and provides the service technician with diagnostic information. A diagnostic screen appears on the display unit 30. The diagnostic screen may prompt the service technician to initiate the diagnostic routine, or alternatively, the diagnostic routine may begin automatically after the initial servicing is performed.

As part of the diagnostic routine, the pressure detecting unit 10 detects a pressure of the air stream at a point along the air flow path in the cleaner air system. As an example, the pressure detecting unit 10 may be an air pressure sensor. The pressure detecting unit 10 then communicates this information to the determining unit 20.

The determining unit 20 then determines whether the detected pressure $P_D$ is within a predetermined margin from a fault threshold pressure $P_{T1}$. If the cleaner air system is functioning properly, the detected pressure $P_D$ is typically much greater than the fault threshold pressure $P_{T1}$. As toner deposits begin to accumulate in the cleaner air system, the air stream pressure decreases and the level of vacuum increases. If the detected pressure $P_D$ decreases such that a difference between the detected pressure and the fault threshold pressure $P_{T1}$ is less than a predetermined margin, there is a risk that air stream pressure will reach the fault threshold pressure $P_{T1}$ prior to the next periodic servicing.

Thus, if the determining unit 20 determines that a difference between the detected pressure $P_D$ and the fault threshold pressure $P_{T1}$ is less a predetermined margin, then the determining unit 20 communicates a fault code and associated information regarding additional servicing that may need to be performed to the display unit 30.

The display unit 30 displays the fault code and the associated information regarding additional servicing. The fault code may be displayed along with an associated list of suggested actions to be taken by the service technician. Alternatively, the service technician may consult a separate manual that lists the suggested actions associated with the fault code that is displayed. Further, a separate, unique fault code may be associated with each of the suggested actions. The display unit 30 may include a GUI interface allowing the service technician to input information indicating completion of one or more of the suggested actions. Further, the diagnostic system may be connected to a network (e.g. LAN, Internet) that allows that the service technician to gather more information regarding the suggested actions. A diagnostic system according to the present disclosure may be part of the image processing apparatus itself or an external unit that is connected to the image processing apparatus. For example, the determining unit 20 and the display unit 30 may be part of an external unit that a service technician connects to the particular device that is being serviced.

Figure 4:
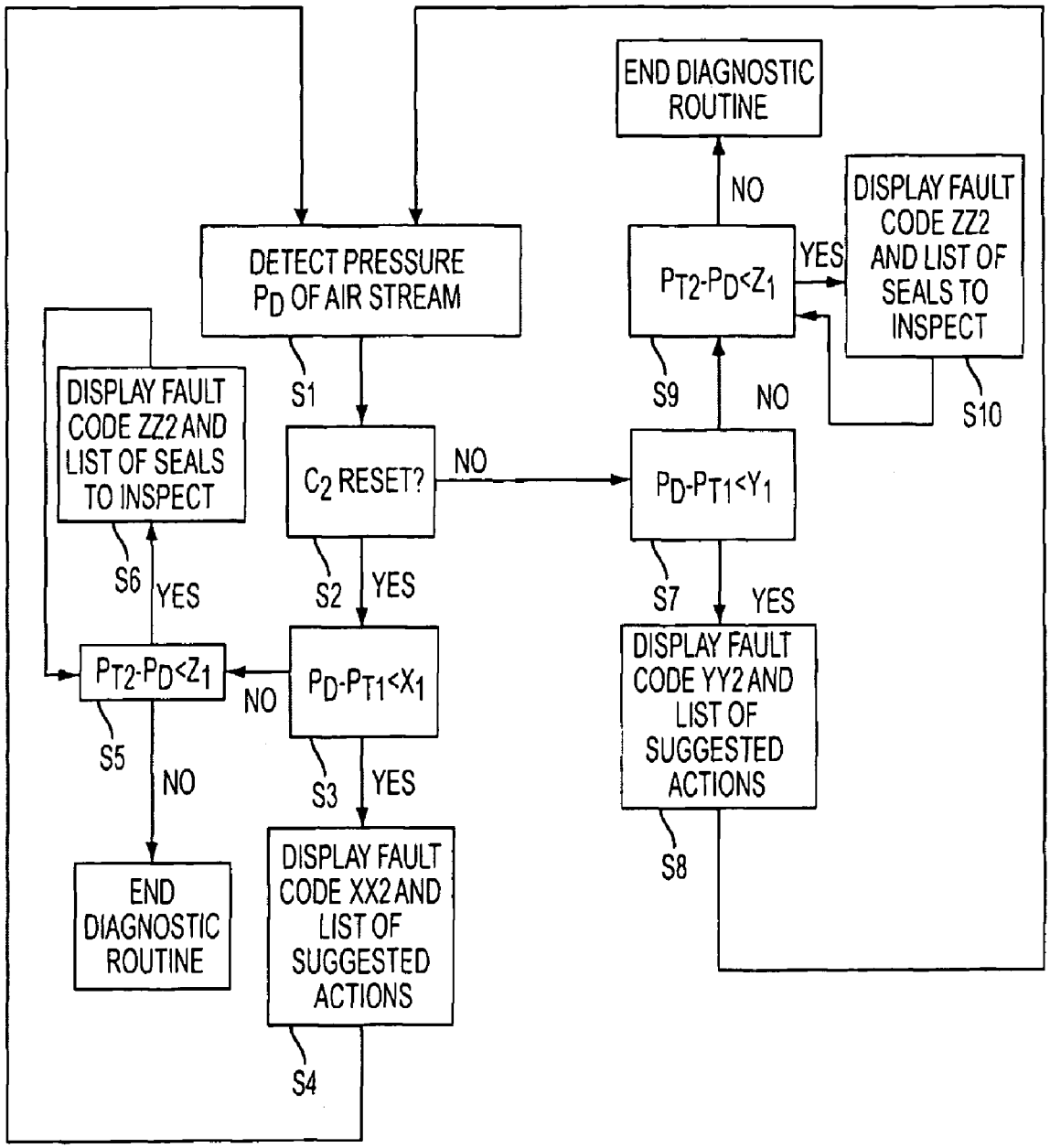
FIG. 4 is a flow diagram of a diagnostic method according to an exemplary embodiment of the present disclosure.

Exemplary diagnostic methods for providing service information according to the present disclosure will be discussed in reference to FIGS. 4 and 5. Referring to FIG. 4, in a diagnostic method according to the present disclosure, in step S1 a pressure $P_D$ is detected at a point along the air flow path in the cleaner air system. In step S2, it is determined whether the counter C2 associated with the final filter has been reset. If it is determined that the counter C2 has been reset (indicating that the filter has been replaced), then the process proceeds to step S3 where it is determined whether a difference between the detected pressure $P_D$ and the fault threshold pressure $P_{T1}$ is less than a predetermined margin $X_1$. The predetermined margin $X_1$ is chosen such that if the difference between the detected pressure $P_D$ and the fault threshold pressure $P_{T1}$ is greater than or above the predetermined margin $X_1$, there is substantial Xerox® in-house testing that indicates that the pressure level in the cleaner air system will not reach the fault threshold pressure $P_{T1}$ prior to the next regular servicing. The predetermined margin $X_1$ may be, for example, 40 mm H20 for a new Nuvera™.

If the determination in step S3 is YES, the method proceeds to step S4 and a fault code (e.g. XX2) indicating that additional servicing is recommended is displayed to the service technician. Along with the fault code, a list of suggested actions to be taken by the service technician are displayed. In step S4, the list of suggested actions includes (i) cleaning of the first manifold if the first manifold was not replaced during the initial servicing and cleaning of the first manifold was not performed during the initial servicing, (ii) replacement of the first manifold if cleaning of the first manifold was performed during the initial servicing, and (iii) additional cleaning of the second manifold. Upon performing one or more of these suggested actions, the diagnostic routine is once again initiated.

Alternately, if the determination in step S2 is NO (indicating the filter has not been replaced), the method proceeds to step S7 and it is determined whether a difference between the detected pressure $P_D$ and the fault threshold pressure $P_{T1}$ is less than a predetermined margin $Y_1$. The predetermined margin $Y_1$ is chosen such that if the difference between the detected pressure $P_D$ and the fault threshold pressure $P_{T1}$ is greater than or equal to the predetermined margin $Y_1$, there is substantial in-house testing conducted by Xerox® that indicates that the pressure level in the cleaner air system will not reach the fault threshold pressure $P_{T1}$ prior to the next regular servicing. The predetermined margin $Y_1$ is less than the margin X1 because the filter has not been replaced.

If the determination in step S7 is YES, the method proceeds to step S8 and a fault code (e.g. YY2) indicating that additional servicing is recommended is displayed to the service technician. Along with the fault code, a list of suggested actions to be taken by the service technician are displayed. In step S8, the list of suggested actions includes (i) replacement of the filter, (ii) cleaning of the first manifold if the first manifold was not replaced during the initial servicing and cleaning of the first manifold was not performed during the initial servicing, (iii) replacement of the first manifold if cleaning of the first manifold was performed during the initial servicing, and (iv) additional cleaning of the second manifold. The list of suggested actions in step S8 differs from the list of suggested actions in step S4 in that it includes replacement of the filter because the filter was not replaced during the initial servicing. Upon performing one or more of these suggested actions, the diagnostic routine is once again initiated.

Alternately, if in either S3 or S7, the determination is made that the difference between the detected pressure $P_D$ and the fault threshold pressure $P_{T1}$ is less than the predetermined margin $X_1$ or $Y_1$, respectively, the method proceeds to either S5 or S9, respectively. In step S5, and in step S9, it is determined whether a difference between a second fault threshold pressure $P_{T2}$ and the detected pressure $P_D$ is less than a predetermined margin $Z_1$. The margin $Z_1$ may be different or the same as the margins $X_1$ or $Y_1$ discussed earlier.

If the determination in step S5 (and similarly in S9) is YES, a fault code ZZ2 is displayed and an associated list of seals to inspect is displayed. The list may be prioritized based on the likelihood that a particular seal has failed. A service technician will then inspect the seals according to the list provided and use his/her judgment as to which seal needs replacement. After the service technician has performed the recommended actions, the method proceeds again to step S5 (or S9) and a determination is once again made as to whether the difference between the second fault threshold pressure $P_{T2}$ and the detected pressure $P_D$ is less than the predetermined margin $Z_1$. If the determination is YES, the method proceeds as discussed above. Alternatively, if the determination in step S5 (and similarly for step S9) is NO, the diagnostic routine ends.

It should be noted that the fault codes are not limited to the particular ones described above or depicted in FIG. 4, and may be any designation that is preferable. Further, the particular fault threshold pressure levels and the predetermined margins are not limited to those described above and may be any suitable values depending on the type and age of the image processing apparatus.

In other exemplary embodiments of the present disclosure, there may be provided a plurality of pressure detecting units along the air flow path in the cleaner air system. For example, in an exemplary embodiment, a first pressure detecting unit may be provided to detect the pressure across the first manifold and a second pressure detecting unit may be provided to detect the pressure drop across the second manifold. As such, the first pressure detecting unit may be provided in proximity to the junction between the first manifold and the second manifold, and the second pressure detecting unit may be provided in proximity to the junction between the second manifold and the final filter.

A diagnostic method performed by a diagnostic system that includes a plurality of pressure detecting units (e.g. two pressure detecting units) proceeds similarly to the diagnostic method described in reference to FIG. 4, and will be described in reference to FIG. 5.

Figure 5:
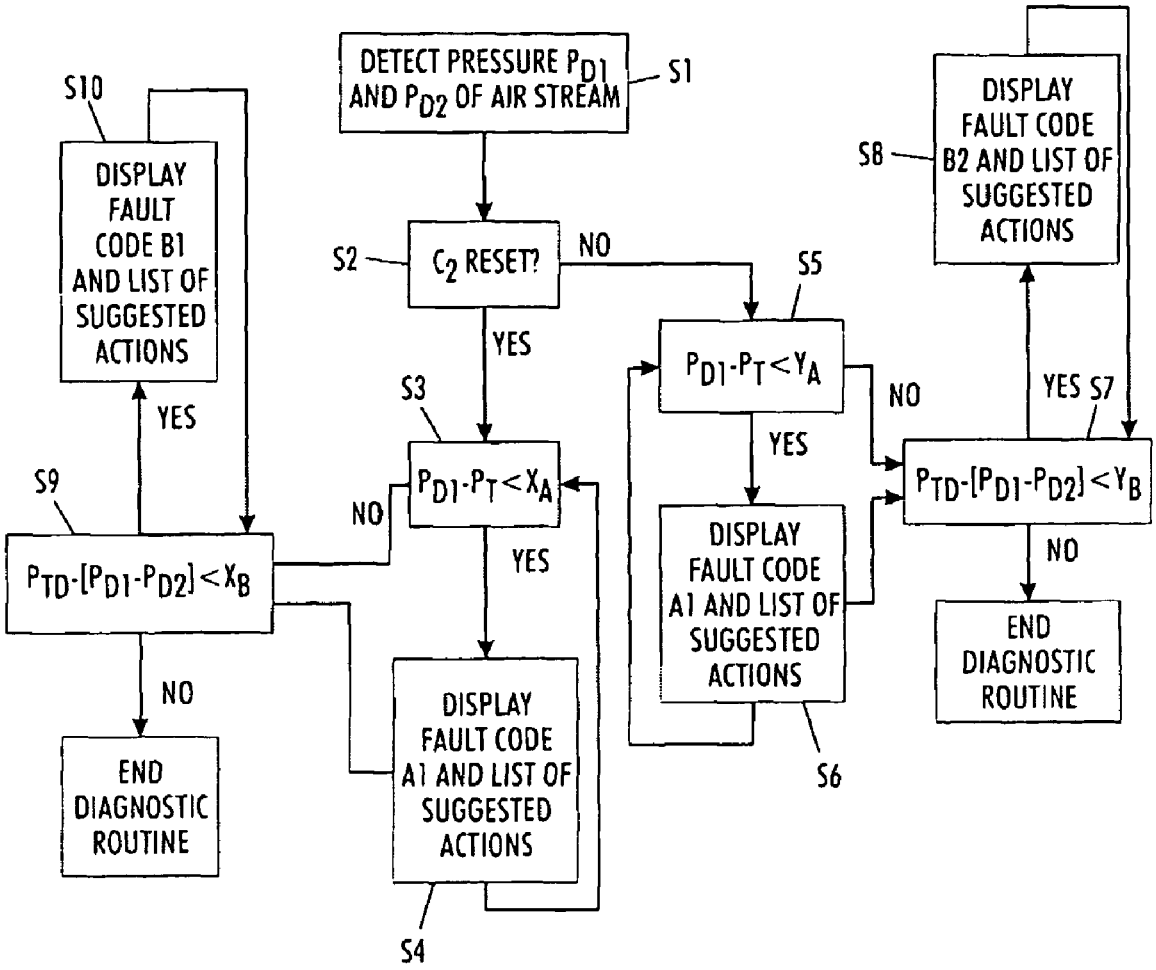
FIG. 5 is a flow diagram of a diagnostic method according to another exemplary embodiment of the present disclosure.

Referring to FIG. 5, in step S1, a pressure $P_{D1}$ is detected at a first point in the air flow path and a pressure $P_{D2}$ is detected at a second point in the air flow path. As described above, a first pressure detecting unit may be provided in proximity to the junction between the first manifold and the second manifold in order to detect $P_{D1}$, and a second pressure detecting unit may be provided in proximity to the junction between the second manifold and the final filter in order to detect $P_{D2}$. In step S2, it is determined whether the counter $C_2$ associated with the final filter has been reset. If it is determined that the counter $C_2$ has been reset (indicating that the filter has been replaced), then the process proceeds to step S3.

In step S3, it is determined whether a difference between the pressure detected $P_{D1}$ by the first pressure detecting unit and a predetermined fault threshold pressure $P_T$ is less than a predetermined margin $X_A$. If the determination in step S3 is YES, the routine goes to step S4, and fault code A1 is displayed along with a list of suggested actions that includes (i) cleaning of the first manifold if the first manifold was not replaced during the initial servicing and cleaning of the first manifold was not performed during the initial servicing and (ii) replacement of the first manifold if cleaning of the first manifold was performed during the initial servicing.

Referring back to step S2, if it is determined that the counter $C_2$ associated with the final filter has not been reset (i.e. the final filter has not been replaced), the diagnostic routine proceeds to step S5, where it is determined whether a difference between the pressure $P_{D1}$ detected by the first pressure detecting unit and the fault threshold pressure $P_T$ is less than a predetermined margin $Y_A$. The acceptable margin $Y_A$ is less than $X_A$ because the filter has not been replaced. If the determination in step S5 is YES, fault code A1 is displayed along with the same list of recommended servicing actions discussed above.

From both step S3 and step S4, the routine proceeds to step S9, where it is determined whether a difference between the pressure $P_{D1}$ detected by the first pressure detecting unit and the pressure $P_{D2}$ detected by the second pressure detecting unit is within a second predetermined margin $X_B$ from a predetermined fault threshold pressure difference $P_{TD}$. For example, it is determined whether a pressure drop across the second manifold is within a predetermined margin $X_B$ from a predetermined fault threshold pressure difference $P_{TD}$ that is determined as value at which the second manifold is no longer functioning effectively.

If the determination in step S9 is YES, fault code B1 is display along with a list of suggested actions including (i) cleaning of the second manifold. On the other hand, if the determination in step S9 is NO, the diagnostic routine is ended. Similarly to step S9, the diagnostic routine proceeds to step S7 from both S5 and S6. The determination that is made in step S7 is similar to the determination that is made in step S9. However, in step S7, the second predetermined margin is $Y_B$ rather than $X_B$. $Y_B$ is less than $X_B$ because the final filter has not been replaced. If the determination in step S7 is YES, fault code B2 is displayed along with a list of suggested actions including (i) replacement of the final filter, and (ii) cleaning of the second manifold. If the determination in step S7 is NO, the diagnostic routine is ended.

According to an embodiment of the present disclosure described in reference to FIG. 5, it is possible to provide the service technician with more specific recommended servicing. In particular, by providing two pressure detecting units it is possible to perform a more sophisticated calculation to determine whether the first manifold, the second manifold, or both are contributing to the pressure drop in the air flow path.

It should be noted that the fault codes are not limited to the particular ones described above or depicted in FIG. 5, and may be any designation that is preferable. Further, the particular fault threshold pressure levels and the predetermined margins are not limited to those described above and may be any suitable values depending on the type and age of the image processing apparatus.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A diagnostic system that provides a service technician with service information during servicing of an image processing apparatus, the image processing apparatus including a first manifold, a second manifold, and a filter, the first and second manifolds and the filter being disposed along an air flow path for removal of toner particles, the diagnostic system comprising:

at least one counter that is incremented during operation of the image processing apparatus based on predetermined criteria;

a pressure detecting unit that detects a pressure at a point in the air flow path on the condition that the at least one counter is reset to zero after initial servicing of the image processing apparatus;

a determining unit that determines whether a difference between the pressure detected by the pressure detecting unit and a fault threshold pressure is less than a predetermined margin, the fault threshold pressure being lower than the pressure detected by the pressure detecting unit; and a display unit that displays a fault code indicating additional servicing of the image processing apparatus is recommended on the condition that the determining unit determines that the difference between the pressure detected by the pressure detecting unit and the threshold pressure is less than the predetermined margin, wherein the at least one counter includes a first counter corresponding to the filter and a second counter corresponding to the first and second manifolds, the first counter is reset to zero on the condition that the filter is replaced during initial servicing and the second counter is reset to zero after initial servicing of the first and the second manifolds is performed, and on the condition that the first counter is not reset to zero and the second counter is reset to zero, the predetermined margin is $Y_1$ and on the condition that both the first counter and the second counter are reset to zero, the predetermined margin is $X_1$, $X_1$ being greater than $Y_1$.

2. The diagnostic system of claim 1, wherein on the condition that the determining unit determines that the difference between the pressure detected by the pressure detecting unit and the predetermined threshold pressure is less than the predetermined margin $X_1$, the additional servicing indicated by the fault code includes a list of suggested actions to be taken by the service technician including (i) cleaning of the first manifold if the first manifold was not replaced during the initial servicing and cleaning of the first manifold was not performed during the initial servicing, (ii) replacement of the first manifold if cleaning of the first manifold was performed during the initial servicing, and (iii) additional cleaning of the second manifold, and wherein the list of suggested actions is displayed by the display unit in association with the fault code.

3. The diagnostic system of claim 1, wherein on the condition that the determining unit determines that the difference between the pressure detected by the pressure detecting unit and the predetermined threshold pressure is less than the predetermined margin $Y_1$, the additional servicing indicated by the fault code includes a list of suggested actions to be taken by the service technician including (i) replacement of the filter, (ii) cleaning of the first manifold if the first manifold was not replaced during the initial servicing and cleaning of the first manifold was not performed during the initial servicing, (iii) replacement of the first manifold if cleaning of the first manifold was performed during the initial servicing, and (iv) additional cleaning of the second manifold, and wherein the list of suggested actions is displayed by the display unit in association with the fault code.

4. The diagnostic system of claim 1, wherein on the condition that a difference between a second fault threshold pressure and the pressure detected by the pressure detecting unit is less than a third predetermined margin, the display unit displays a fault code indicating additional servicing of the image processing apparatus is recommended, the additional servicing including inspection of seals disposed in the image processing apparatus along the air flow path.

5. The diagnostic system of claim 4, wherein the display unit further displays, in association with the fault code, a list of seals to be inspected, the list being prioritized based on a likelihood of a seal to fail.

6. A diagnostic method for providing service information during servicing of an image processing apparatus, the image processing apparatus including a first manifold, a second manifold, and a filter, each of which are disposed along an air flow path for removal of toner particulate deposits, the diagnostic method comprising: detecting a pressure at a point in the air flow path on the condition that at least one counter is reset to zero after initial servicing of the image processing device, wherein the at least one counter is incremented during operation of the image processing device based on predetermined criteria;

determining whether a difference between the detected pressure and a fault threshold pressure is less than a predetermined margin;

displaying a fault code indicating additional servicing of the image processing apparatus is recommended on the condition that it is determined that the difference between the detected pressure and the fault threshold pressure is less than the predetermined margin, wherein the at least one counter includes a first counter corresponding to the filter and a second counter corresponding to the first and second manifolds, the first counter is reset to zero on the condition that the filter is replaced during initial servicing and the second counter is reset to zero after initial servicing of the first and the second manifolds is performed, and on the condition that the first counter is not reset to zero and the second counter is reset to zero, the predetermined margin is $Y_1$ and on the condition that both the first counter and the second counter are reset to zero, the predetermined margin is $X_1$, $X_1$ being greater than $Y_1$.

7. The diagnostic method of claim 6, wherein on the condition that it is determined that the difference between the detected pressure and the predetermined threshold pressure is less than the predetermined margin $X_1$, the additional servicing indicated by the fault code includes a list of suggested actions to be taken by the service technician including (i) cleaning of the first manifold if the first manifold was not replaced during the initial servicing and cleaning of the first manifold was not performed during the initial servicing, (ii) replacement of the first manifold if cleaning of the first manifold was performed during the initial servicing, and (iii) additional cleaning of the second manifold, and wherein the displaying step further comprises displaying the list of suggested actions in association with the fault code.

8. The diagnostic method of claim 6, wherein on the condition that it is determined that the difference between the detected pressure and the predetermined threshold pressure is less than the predetermined margin $Y_1$, the additional servicing indicated by the fault code includes a list of suggested actions to be taken by the service technician including (i) replacement of the filter, (ii) cleaning of the first manifold if the first manifold was not replaced during the initial servicing and cleaning of the first manifold was not performed during the initial servicing, (iii) replacement of the first manifold if cleaning of the first manifold was performed during the initial servicing, and (iv) additional cleaning of the second manifold, and wherein the displaying step further comprises displaying the list of suggested actions in association with the fault code.

9. The diagnostic method of claim 6, wherein the predetermined criteria is a number of latent images formed or a number of prints, and wherein on the condition that the predetermined criteria is the number of latent images formed, the at least one counter is incremented by one after each latent image is formed, and wherein on the condition that the predetermined criteria is the number of prints, the at least one counter is incremented by one after each print.

10. The diagnostic method of claim 6, wherein the initial servicing is performed after the at least one counter reaches a predetermined limit that is based on air flow and toner type.

11. A diagnostic system that provides a service technician with service information during servicing of an image processing apparatus, the image processing apparatus including a first manifold, a second manifold, and a filter, each of which are disposed along an air flow path for removal of toner particulate deposits, the diagnostic system comprising:

at least one counter that is incremented during operation of the image processing apparatus based on predetermined criteria;

a first pressure detecting unit that detects a first pressure at a first point along the air flow path on the condition that the at least one counter is reset to zero after initial servicing of the image processing apparatus;

a second pressure detecting unit that detects a second pressure at a second point along the air flow path on the condition that the at least one counter is reset to zero after initial servicing of the image processing apparatus;

a determining unit that determines whether a difference between the pressure detected by the first pressure detecting unit and a fault threshold pressure is less than a first predetermined margin and that determines whether a difference between the pressure detected by the first pressure detecting unit and the pressure detected by the second pressure detecting unit is within a second predetermined margin from a predetermined fault threshold pressure difference;

a display unit that displays a fault code indicating additional servicing of the image processing apparatus is recommended on the condition that the determining unit determines that at least one of:

(i) the difference between the pressure detected by the first pressure detecting unit and the fault threshold pressure is less than the first predetermined margin, and (ii) the difference between the pressure detected by the first pressure detecting unit and the pressure detected by the second pressure detecting unit is within a second predetermined margin from a predetermined fault threshold pressure difference, wherein the at least one counter includes a first counter corresponding to the filter and a second counter corresponding to the first and second manifolds, and the first counter is reset to zero on the condition that the filter is replaced during initial servicing and the second counter is reset to zero after initial servicing of the first and the second manifolds is performed.

12. The diagnostic system of claim 11, wherein on the condition that the first counter is not reset to zero and the second counter is reset to zero, the first predetermined margin is $Y_A$ and the second predetermined margin is $Y_B$, and on the condition that both the first counter and the second counter are reset to zero, the first predetermined margin is $X_A$ and the second predetermined margin is $X_B$, $X_A$ and $X_B$ being greater than $Y_A$ and $Y_B$, respectively.

13. The diagnostic system of claim 12, wherein on the condition that the determining unit determines that the difference between the pressure detected by the first pressure detecting unit and the fault threshold pressure is less than the predetermined margin $X_A$, the additional servicing indicated by the fault code includes a list of suggested actions to be taken by the service technician including (i) cleaning of the first manifold if the first manifold was not replaced during the initial servicing and cleaning of the first manifold was not performed during the initial servicing and (ii) replacement of the first manifold if cleaning of the first manifold was performed during the initial servicing, and wherein on the condition that the determining unit determines that the difference between the pressure detected by the first pressure detecting unit and the pressure detected by the second pressure detecting unit is within the second predetermined margin $X_B$ from the predetermined fault threshold pressure difference, the additional servicing indicated by the fault code includes a list of suggested actions to be taken by the service technician including (i) cleaning of the second manifold, and wherein the list of suggested actions is displayed by the display unit in association with the fault code.

14. The diagnostic system of claim 12, wherein on the condition that the determining unit determines that the difference between the pressure detected by the first pressure detecting unit and the predetermined threshold pressure is less than the predetermined margin $Y_A$, the additional servicing indicated by the fault code includes a list of suggested actions to be taken by the service technician including (i) cleaning of the first manifold if the first manifold was not replaced during the initial servicing and cleaning of the first manifold was not performed during the initial servicing, and (ii) replacement of the first manifold if cleaning of the first manifold was performed during the initial servicing, and wherein on the condition that the determining unit determines that the difference between the pressure detected by the first pressure detecting unit and the pressure detected by the second pressure detecting unit is within the second predetermined margin $Y_B$ from the predetermined fault threshold pressure difference, the additional servicing indicated by the fault code includes a list of suggested actions to be taken by the service technician including (i) replacement of the final filter, and (ii) cleaning of the second manifold, and wherein the list of suggested actions is displayed by the display unit in association with the fault code.

15. A xerographic device, comprising:

the diagnostic system of claim 1.

* * * * *